US005329676A

United States Patent [19]

Kobayashi

[11] Patent Number: 5,329,676

[45] Date of Patent: Jul. 19, 1994

[54] BUCKLE DEVICE OF SEAT BELT UNIT AND METHOD FOR CONNECTING BUCKLE COVER IN SAID BUCKLE DEVICE

[75] Inventor: Katsuhiko Kobayashi, Youkaichi, Japan

[73] Assignee: Takata Corporation, Tokyo, Japan

[21] Appl. No.: 38,635

[22] Filed: Mar. 29, 1993

[30] Foreign Application Priority Data

Apr. 2, 1992 [JP] Japan ..... 4-080981

[51] Int. Cl.[5] ..... A44B 11/00

[52] U.S. Cl. ..... 24/633; 24/573.1; 24/634

[58] Field of Search ..... 24/633, 634, 602, 603, 24/606, 573.1, 573.6; 70/63, 68, 55, 56

[56] References Cited

U.S. PATENT DOCUMENTS 4,674,303 6/1987 Salcone, II ..... 24/633
4,731,912 3/1988 Boriskie et al. ..... 24/633
4,878,277 11/1989 Portuese ..... 24/633
4,987,662 1/1991 Haffey et al. ..... 24/633
5,129,129 7/1992 Collins et al. ..... 24/633

*Primary Examiner*—Victor N. Sakran
*Attorney, Agent, or Firm*—Varndell Legal Group

[57] ABSTRACT

In the present invention, a lock pin 6 is temporarily fixed on an upper cover 2 in advance. Then, the upper cover 2 and a lower cover 3 are connected together by inserting a wall 10 between a pair of walls 4 and 5 and by aligning holes 7 and 8 with a hole 11. By pushing a release button 9 under this condition, the temporarily fixed lock pin 6 is inserted into the holes 7, 8 and 11 and is set at a predetermined connecting position. Thus, the upper cover 2 and the lower cover 3 are mechanically connected by the lock pin 6. As the result, the upper cover and the lower cover can be relatively easily and reliably connected together without requiring a special tool. The cover is not easily disassembled by outsiders, and good external appearance can be provided.

16 Claims, 3 Drawing Sheets

Fig. 4
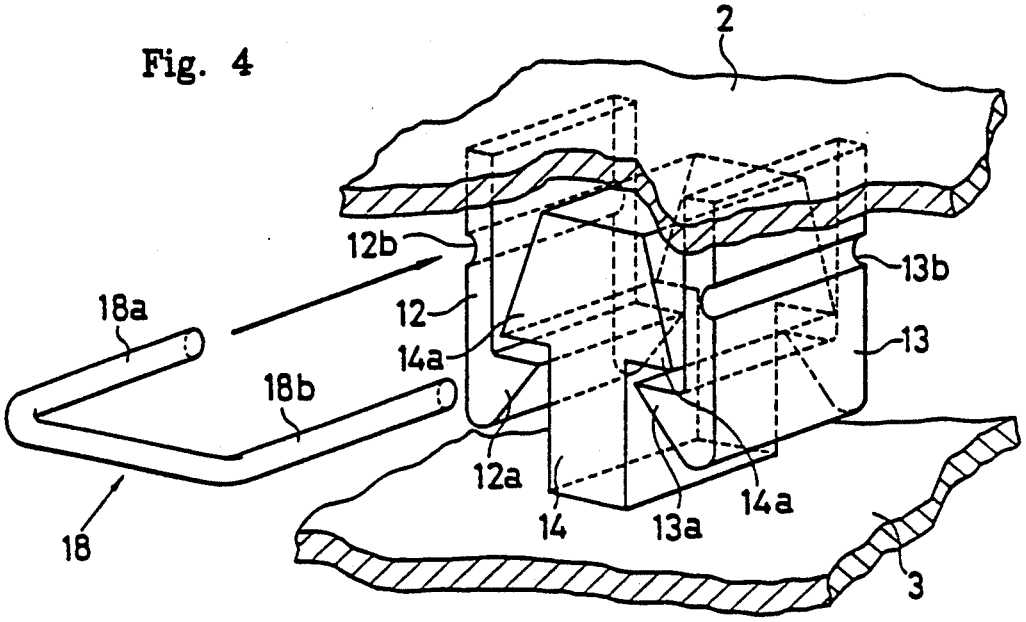
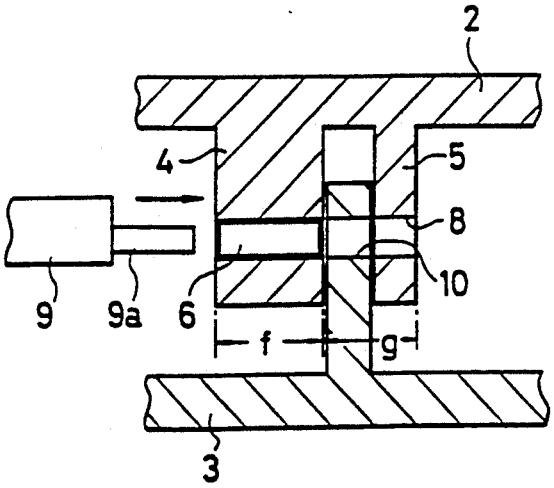
Fig. 5(a)
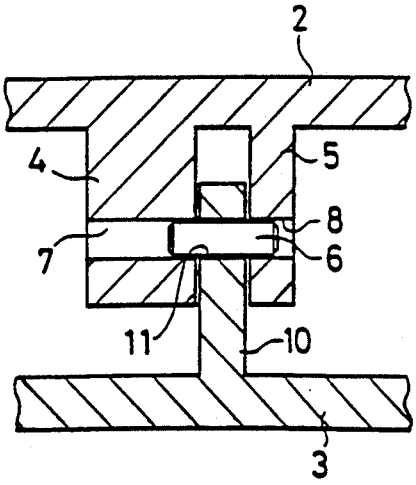
Fig. 5(b)

BUCKLE DEVICE OF SEAT BELT UNIT AND METHOD FOR CONNECTING BUCKLE COVER IN SAID BUCKLE DEVICE

BACKGROUND OF THE INVENTION

The present invention relates to a buckle device, into which a tongue is inserted and engaged when seat belt is put on by an occupant of a vehicle and a method for connecting said buckle device in a seat belt unit, which is provided on a seat of an automobile or other vehicle for restraining and protecting the occupant in an emergency such as vehicle collision. In particular, the invention relates to a buckle device having a buckle cover where an upper cover and a lower cover are connected together, and to a method for connecting said buckle device.

At present, seat belt unit is provided on seat of various types of vehicle such as automobile in order to protect the occupant of the vehicle in an emergency such as vehicle collision. The seat belt unit of this type generally comprises a tongue attached to the seat belt and a buckle device, with which the tongue is engaged. By engaging or disengaging the tongue and the buckle device, the seat belt can be easily put on or off.

In a conventional type buckle device, a buckle cover is used to cover the mechanism of the buckle. This buckle cover is generally divided into upper and lower parts, i.e. the buckle cover is formed by connecting the upper cover and the lower cover together. As the conventional methods to connect these two covers, there are welding method, fastener method and screw method.

The welding method is a method to connect the upper and the lower covers by welding. By the fastener method, a female type engaged portion is formed on the upper cover, and a male type engaging portion is provided on the lower cover. After inserting and engaging the engaging portion into the engaged portion, a lock pin is used to firmly hold the engagement between the engaging portion and the engaged portion. Further, in the screw method, the upper cover and the lower cover are overlapped on each other, and they are connected by screw.

However, it is not possible to confirm whether these covers are completely welded or not in the welding method, and problem arises that the reliability of connection is not sufficient. In the fastener method, the lock pin must be struck from outside. Thus, the lock pin thus struck or the striking point is exposed to outside. This not only impairs external appearance but also a special tool for striking the lock pin is required. Further, in the screw method, direct exposure of the screw to outside impairs external appearance. Also, outsiders may mischievously remove the screw and expose internal buckle mechanism to outside.

SUMMARY OF THE INVENTION

It is an object of the present invention to provide a buckle device in a seat belt unit and a method for connecting said buckle device, by which it is possible to connect relatively easily and reliably without requiring a special tool and to improve reliability of connection, and which provides good external appearance and cannot be easily disassembled by outsiders.

To solve the above problems, the buckle device of a seat belt unit according to the present invention comprises a buckle mechanism engaged with a tongue when the tongue is inserted into it as the seat belt is put on, a release member for releasing engagement of the tongue with the buckle mechanism, and a buckle cover formed by connecting an upper cover and a lower cover and for receiving at least a part of said buckle mechanism and said release member, whereby holes for connecting are formed on said upper cover and said lower cover, said upper cover and said lower cover are connected together by inserting a lock pin into these holes and by setting the covers at a predetermined connecting position, and said predetermined connecting position is set at such position that said lock pin can be set by a movable member of said seat belt unit.

Also, the buckle device of a seat belt unit according to the present invention comprises a buckle mechanism engaged with a tongue when the tongue is inserted into it as the seat belt is put on, a release member for releasing engagement of the tongue with the buckle mechanism, and a buckle cover formed by connecting an upper cover and a lower cover and for receiving at least a part of said buckle mechanism and said releasing member, whereby an engaging portion is formed on each of said upper cover and said lower cover, disengagement of said upper cover from said lower cover is prevented because the engaging portions are engaged with each other against a direction to disengage the upper and lower covers when said upper cover and said lower cover are connected with each other, a release checking groove is formed on at least one of these engaging portions, and disengagement of the engaging portion of said upper cover with engaging portion of said lower cover is prevented by a release preventing member inserted into the release checking groove, further the engaging position of said release preventing member in the release checking groove is set at a position where said release preventing member can be inserted by a movable member of said seat belt unit.

The movable member of said seat belt unit comprises a release member for releasing engagement of the tongue with the buckle mechanism, a tongue, or a tongue and an ejector.

Further, the method for connecting a buckle device in a seat belt unit according to the present invention comprises a buckle mechanism engaged with a tongue when the tongue is inserted into it as the seat belt is put on, a release member for releasing engagement of the tongue with the buckle mechanism, and a buckle cover formed by connecting an upper cover and a lower cover and receiving at least a part of said buckle mechanism and said release member, whereby holes for connecting are formed in an extended area of moving area of a movable member of said seat belt unit, a lock pin is temporarily fixed on moving area of the movable member of said seat belt unit in at least one of said upper cover and said lower cover or in the movable member of said seat belt unit, and said lock pin is inserted into said holes and is set at a predetermined connecting position by moving the movable member of seat seat belt unit with said holes of said upper and lower covers kept in aligned state.

Further, the method for connecting a buckle device in a seat belt unit according to the present invention comprises a buckle mechanism engaged with a tongue when the tongue is inserted into it as the seat belt is put on, a release member for releasing engagement of the tongue with the buckle mechanism, and a buckle cover formed by connecting an upper cover and a lower cover and receiving at least a part of said buckle mechanism and said release member, whereby disengagement of said upper cover from said lower cover is prevented by engaging an engaging portion formed on each of said upper cover and said lower cover against disengaging direction of the upper and the lower covers when said upper cover and said lower cover are connected with each other, further a release checking groove is formed on an extended area of moving area of the movable member of said seat belt unit on one of these engaging portions, a release preventing member is temporarily fixed on moving area of the movable member of said seat belt unit on one of said upper cover or said lower cover or on the movable member of said seat belt unit, and disengagement of the engaging portion of said upper cover from the engaging portion of said lower cover is prevented by inserting said release preventing member into said release checking groove by moving the movable member of said seat belt unit.

In the buckle device in a seat belt unit and the method for connecting the buckle device according to the present invention, the upper cover and the lower cover are connected together, and by moving the movable member of the seat belt unit such as the release member for releasing the engagement of the tongue with the buckle mechanism, tongue, or tongue and ejector, lock pin or release preventing member is inserted into holes or into release checking groove, and the upper cover and the lower cover are connected reliably and firmly.

When the upper cover and the lower cover are connected with each other, lock pin on the connecting portion or the release preventing member are positioned inside the buckle cover. Thus, these members are not seen from outside, providing good external appearance.

Because the upper cover and the lower cover are mechanically and firmly connected with each other by the lock pins or the release preventing member, the reliability of the connecting the upper and the lower covers becomes very high. Because the connecting portion is not seen from outside, mischievous disassembling of the buckle cover by outsiders can be perfectly prevented.

Further, because the lock pin or the release preventing member can be assembled by simply moving the movable members of the seat belt unit, no special tool for assembling is required, and this saves labor and time for assembling and facilitates the assembling.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

FIG. 4 is a partial perspective view schematically illustrating still another embodiment of the invention;

FIGS. 5 (*a*) and 5 (*b*) represent another embodiment of the invention, in which (*a*) is a drawing similar to FIG. 2, and (*b*) is a cross-sectional view similar to FIG. 1;

DESCRIPTION OF THE PREFERRED EMBODIMENTS

Figure 1:
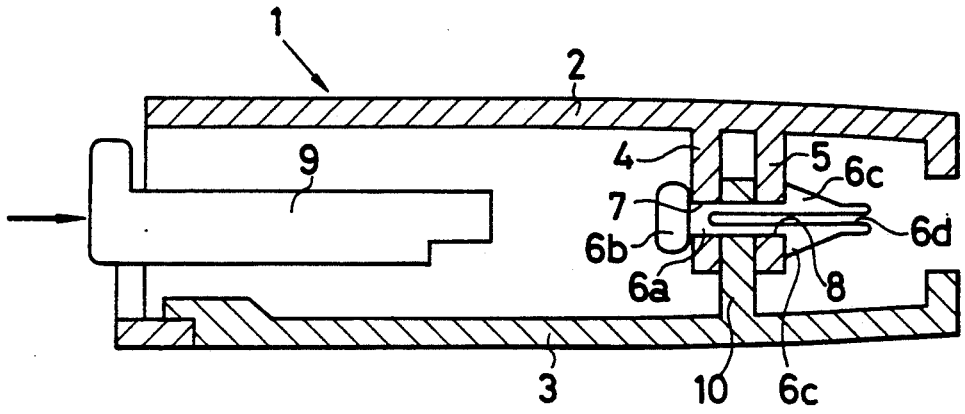
FIG. 1 a cross-sectional view schematically illustrating an embodiment of a buckle device in a seat belt unit and a method for connecting a buckle cover in the buckle device.

As shown in FIG. 1, a buckle cover 1 is divided to an upper cover 2 and a lower cover 3 in the buckle device of the present invention, as in the conventional buckle device. On one of the upper cover 2 and the lower cover 3, a buckle mechanism is attached, which comprises an engaging mechanism for engaging an inserted tongue and a release mechanism for releasing said engagement. (In the present embodiment, it is explained that the buckle mechanism is attached on the upper cover 2.) As such buckle mechanism, any of conventional type buckle mechanisms may be used although these are not shown.

A pair of walls 4 and 5 for engagement are installed downwardly on inner surface of the upper cover 2. On these walls 4 and 5, holes 7 and 8 with the same diameter, into which lock pins 6 are inserted, are formed. These holes 7 and 8 are positioned within an extended area of moving locus of a release button 9 for releasing the engagement of the tongue with the buckle.

On inner surface of the lower cover 3, a wall 10 for engagement is installed upwardly, and the lock pin 6 is inserted into the wall 10. A hole 11 having the same diameter as that of the holes 7 and 8 is formed on the wall 10, and the lock pin 6 is inserted into this hole. In the present embodiment, a pair of walls 4 and 5 are installed on the upper cover 2, and a wall 10 is installed on the lower cover 3. On the contrary, a wall may be installed on the upper cover 2, and a pair of walls may be installed on the lower cover 3.

When the wall 10 is inserted between a pair of walls 4 and 5 and the holes 7 and 8 are aligned with the hole 11, the lock pin 6 is inserted through the holes 7, 8 and 11, and its head **6*b* is engaged on outer side surface of the wall 4, and engaging pawls 6*c* and 6*c* are engaged on outer side surface of the wall 5. Thus, the upper cover 2 and the lower cover 3 are connected together, and the buckle cover 1 is formed. In aligning the holes 7, 8 and 11, a positioning portion such as a positioning projection may be arranged on the upper cover 2 and the lower cover 3 (although not shown in the figure) to facilitate the alignment of the holes 7 and 8 with the hole 11 when the upper cover 2 and the lower cover 3** are assembled.

As shown in this figure, the lock pin 6 comprises a shaft **6*a*, a flange-like head 6*b* formed on one end of the shaft 6*a*, a pair of engaging pawls 6*c* and 6*c* with triangular cross-sections provided each above and below of the other end of the shaft 6*a*, and a slit 6*d* formed in the shaft 6*a* from the other end and extending in axial direction, In FIG. 2, vertical length "a" of the head 6*b* of the lock pin 6 and the length "b" between tips of upper and lower pairs of engaging pawls 6*c* and 6*c* are designed as larger than the diameter "c" of each the holes 7, 8 and 11. However, the length "b" between the tips of the engaging pawls 6*c* is designed in such manner that it becomes smaller than the diameter of each of the holes 7, 8 and 11 when the shaft 6***a* is elastically deformed by the split 6*b*.

The surface of the engaging pawl 6*c* facing on the head 6*b* is designed almost perpendicularly to the shaft 6*a*, and the distance "d" between this surface and the surface of the head 6*b* facing to the engaging pawl 6*c* is designed slightly larger than the distance "e" between outer surfaces of the walls 4 and 5.

Figure 2:
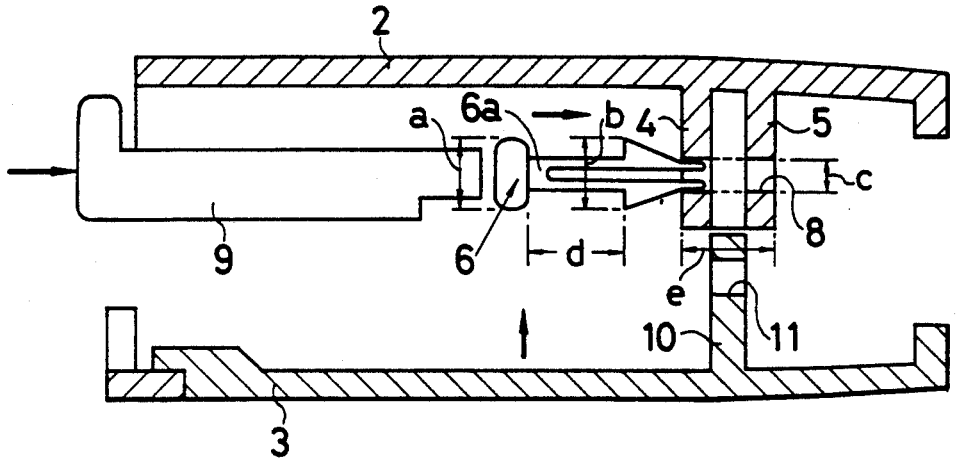
FIG. 2 is a drawing for explaining a method for connecting an upper cover and a lower cover of the embodiment.

To connect the upper cover 2 and the lower cover 3, the lock pin 6 is temporarily fixed on the upper cover 2 in advance by an adequate temporary fixing means (not shown) on the upper cover 2 as shown in FIG. 2. In this case, the lock pin 6 is positioned within an extended area of moving locus of the release button 9 so that central axial line of the lock pin is approximately aligned with the centers of the holes 7 and 8.

Thus, the upper cover 2 with the lock pin 6 temporarily fixed and the lower cover 3 are connected with each other when the wall 10 is inserted between a pair of walls 4 and 5 and the holes 7 and 8 are aligned with the hole 11. By pushing the release button 9 under this condition, the temporarily fixed lock pin 6 can be inserted into the holes 7, 8 and 11 and is set at a predetermined connecting position. In this case, the lock pin 6 pushed by the release button 9 is easily attached on the walls 4 and 5 because the shaft 6*a* undergoes elastic deformation due to the slit 6*d*, and the engaging pawl 6*c* easily passes through the holes 7, 8 and 11. When the force pushing the release button 9 is removed, only the release button 9 returns to the initial position by force of a return spring (not shown) and the lock pin 6 remains at the predetermined position.

Thus, the upper cover 2 and the lower cover 3 are connected together by the lock pin 6. When the upper cover 2 and the lower cover 3 are connected together in this way, the walls 4, 5 and 10 on the connecting portion and the lock pin 6 are positioned inside the buckle cover 1. As the result, these are not seen from outside, providing good external appearance.

Because the upper cover 2 and the lower cover 3 are mechanically and reliably connected with each other by the lock pin 6, the connection between the upper cover 2 and the lower cover 3 has very high reliability. Moreover, the connecting portion is not seen from outside, and mischievous disassembling of the buckle cover 1 by outsiders can be perfectly prevented.

Further, the lock pin 6 can be assembled simply by pushing the release button 9, which is a component parts of the buckle device. Thus, no special tool for assembling is required, and this saves labor and time for assembling and simplifies assembling procedure.

Figure 3:
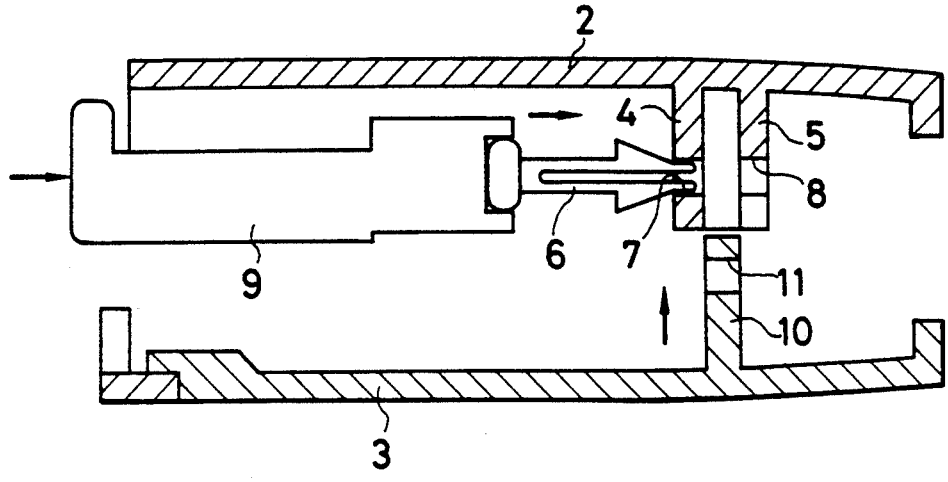
FIG. 3 is a drawing similar to FIG. 2 and shows another embodiment of the present invention.

FIG. 3 is a cross-sectional view showing another embodiment of the present invention.

In contrast to the assembling procedure of the buckle cover in the above embodiment, in which the lock pin 6 is temporarily fixed on the upper cover 2 in advance, the lock pin 6 is temporarily fixed on an end of the release button 9 in this embodiment. By pushing the release button 9 by the similar procedure as in the above embodiment, the lock pin 6 passes through the holes 7, 8 and 11 and is set at the predetermined connecting position, and the upper and the lower covers 2 and 3 are connected together. When the pushing force on the release button is removed, the release button 9 returns to the initial position by a return spring (not shown) as in the conventional way. In this case, the lock pin 6 is separated from the release button 9.

In the present invention, approximately the same effect and the same benefit as in the previous embodiment can be obtained.

FIG. 4 is a partial perspective view of a still another embodiment of the present invention.

As shown in FIG. 4, a pair of legs 12 and 13 for engagement are installed on the upper cover 2, and engaging pawls 12*a* and 13*a* are formed on ends of these legs 12 and 13 respectively. On outer side surfaces of the legs 12 and 13, grooves 12*b* and 13 each having semicircular cross-section are formed. On the other hand, a leg 14 is arranged on the lower cover 3, and an engaging pawl 14*a* engageable with the engaging pawls 12*a* and 13*a* is formed on upper end of the leg 14.

Further, a U-shaped release preventing member 18 made of elastic wire is provided, and a pair of holding portions 18*a* and 18*b* to be inserted into the grooves 12*b* and 13*b* are formed on the release preventing member 18. The spacing between the holding portion 18*a* and 18*b* is designed slightly smaller than the spacing between a pair of grooves 12*b* and 13*b*.

Although not shown, the release preventing member 18 is temporarily fixed on the upper cover 2, the lower cover 3 or the release button 9, similarly to the lock pin of the above embodiment. When the release preventing member 18 moves horizontally, the holding portions 18*a* and 18*b* are arranged at the positions to be inserted into the grooves 12*b* and 13*b* of the legs 12 and 13.

By inserting the leg 14 of the lower cover 3 between a pair of legs 12 and 13 of the upper cover 2, the upper cover 2 and the lower cover 3 are connected together. Under this condition, the leg 14 cannot be easily detached from between a pair of legs 12 and 13 because the engaging pawl 14*a* is engaged with a pair of engaging pawls 12 and 13*a*.

When the release button 9 is pushed in with the upper cover 2 and the lower cover 3 connected together, the holding portions 18*a* and 18*b* of the release preventing member 18 are inserted into the grooves 12*b* and 13*b* and are held at the predetermined inserted positions. With the holding portions 18*a* and 18*b* inserted into the grooves 12*b* and 13*b*, the holding portions 18*a* and 18*b* undergo elastic deformation, being stretched out. Thus, by this elastic force, the holding portions 18*a* and 18*b* press and squeeze the legs 12 and 13. As the result, a pair of engaging pawls 12 and 13*a* are reliably and firmly engaged with the engaging pawl 14*a*, and disengagement of the engaging pawl 14*a* from the pair of engaging pawls 12*a* and 13*a* is prevented. Thus, the upper cover 2 and the lower cover 3 are connected together reliably and firmly.

In the present embodiment, the holding portions 18*a* and 18*b* undergo elastic deformation and squeeze the legs 12 and 13, whereas the holding portions 18*a* and 18*b* may not necessarily press and squeeze the legs 12 and 13 if the structure between the release preventing member 18 and the legs 12 and 13 is such that the holding portions 18*a* and 18*b* are not easily disengaged from the grooves 12 *b* and 13*b* and that the spacing between the engaging pawls 12*a* and 13*a* is widened and disengagement of the engaging pawl 14*a* from a pair of engaging pawls 12*a* and 13*a* can be prevented.

FIGS. 5 (*a*) and 5 (*b*) show a still another embodiment of the present invention.

As shown in FIG. 5 (*a*), a pair of walls 4 and 5 are installed on the upper cover 2 similarly to the embodiment of FIG. 1, while, in the present embodiment, the thickness "f" of the wall 4 closer to the release button 9 is designed as larger than the distance "g" between inner surface of the wall 4 and outer surface of another wall 5.

Further, a cylindrical or hollow-cylindrical lock pin 6 is temporarily supported in a hole 7 of the wall 4. In this case, the lock pin 6 is arranged in such manner that sliding resistance due to friction is slightly generated against the hole 7, and the lock pin 6 cannot be easily come out of the hole 7. Axial length of the lock pin 6 is designed as equal to or slightly smaller than the thickness "f" of the wall 4. Further, when the lock pin 6 is temporarily supported in the hole 7, the lock pin 6 is arranged so as not to protrude at least from the wall 5. On the other hand, on one end of the release button 9 facing to the wall 4, a pressing portion 9*a* is formed so that it can be inserted into the hole 7.

Therefore, when the release button 9 is pushed in, the pressing portion 9*a* advances into the hole 7 and pushes the lock pin 6. Thus, as shown in FIG. 5 (*b*), the lock pin 6 is held at a predetermined connecting position in the holes 7, 8 and 11. In this case, the lock pin 6 is held by friction in the holes 7, 8 and 11. Accordingly, the lock pin 6 does not easily come off from the holes 7, 8 and 11.

In the present embodiment, approximately the same effect and the same benefit as in the previous embodiment can be obtained.

Figure 6:
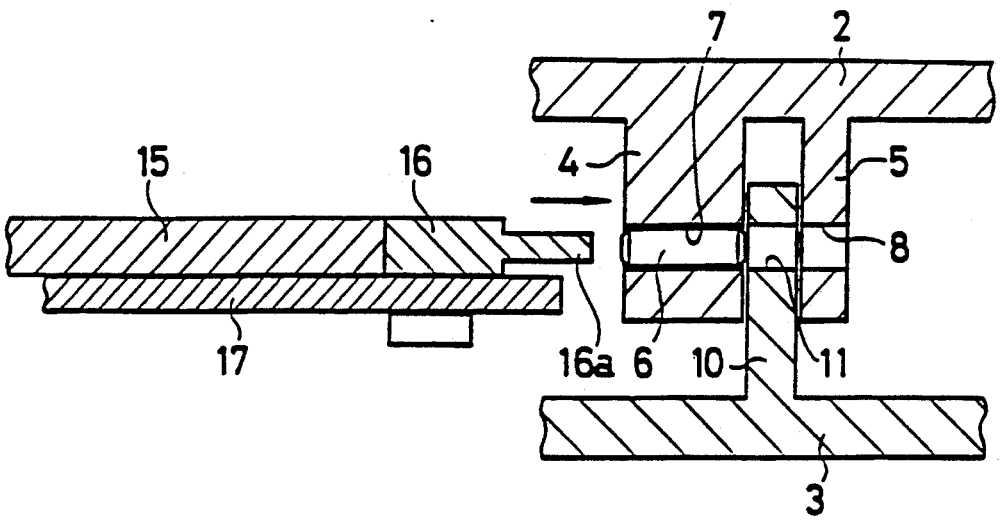
FIG. 6 is a drawing similar to FIG. 2, showing still another embodiment of the present invention.

FIG. 6 represents a still another embodiment of the present invention.

As shown in FIG. 6, the present embodiment is exactly the same in arrangement as the connecting portion of the upper cover 2 and the lower cover 3 in the embodiment of FIGS. 5 (*a*) and 5 (*b*) as described above, while the member to push the lock pin 6 is different from the embodiment of FIGS. 5 (*a*) and 5 (*b*). That is, in the present embodiment, a tongue 15 and an ejector 16 to push the tongue 15 from the buckle are used when the engagement is released as the member to push the lock pin 6 in. On an end of the ejector 16 facing to the wall 4, a pressing portion 16*a* insertable into the hole 7 is formed.

Therefore, when the tongue 15 is inserted into the buckle device, the tip of the tongue 15 presses the ejector 16. Then, the pressing portion 16*a* of the ejector 16 enters the hole 7 and pushes the lock pin 6. Thus, the lock pin 6 is held at the predetermined connecting position in the holes 7, 8 and 11 similarly to the case in FIG. 5 (*b*).

In the present embodiment, approximately the same effect and the same benefit as in the previous embodiment can be obtained.

Figure 7:
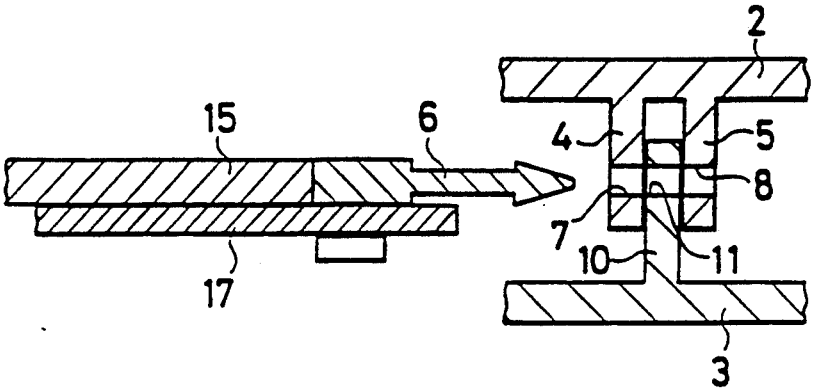
FIG. 7 is a drawing similar to FIG. 2 showing another embodiment of the invention.

FIG. 7 shows a still another embodiment of the invention.

In the embodiment of FIG. 6, the tongue 15 is inserted, and the lock pin 6 is pushed via the ejector 16. In the present embodiment of FIG. 7, the lock pin 6 is directly pushed to the predetermined connecting position in the holes 7, 8 and 11 by the tongue 15. In this case, the lock pin having the same type of engaging pawl as the lock pin of FIG. 1 is used, and it is temporarily supported on a buckle base 17. The walls 4, 5 and 10 formed on the upper and the lower covers 2 and 3 are exactly the same as in the embodiment of FIG. 1.

In the present embodiment, approximately the same effect and the same benefit can be obtained as in the previous embodiment.

Figure 8:
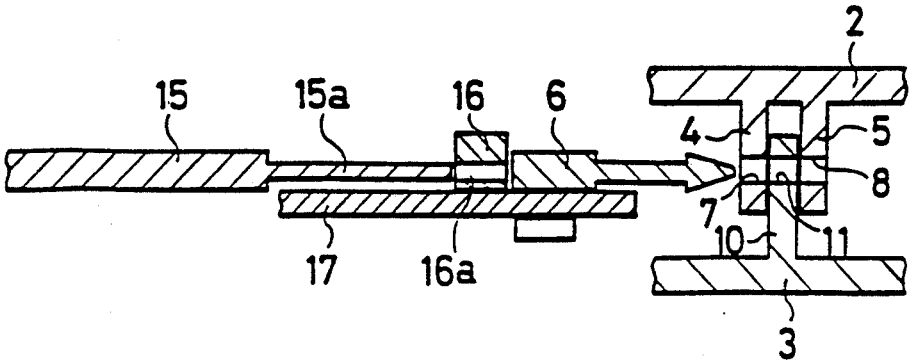
FIG. 8 is a drawing similar to FIG. 2, showing a yet still another embodiment of the present invention.

FIG. 8 shows a still another embodiment of the invention.

In the embodiment of FIG. 7, the ejector 16 is not installed on moving locus of the tongue 15, and the tongue 15 directly pushes the lock pin 6. In contrast, the tongue 5 directly pushes the lock pin 6 even though the ejector 16 is arranged on moving locus of the tongue 15. That is, as shown in FIG. 8, a pressing portion 15*a* to press the lock pin 6 is formed on the forward end of the tongue 15, and a hole 16*a*, into which the pressing portion 15*a* penetrates, is formed on the ejector 16.

When the tongue 15 is inserted into the buckle device to put the seat belt on, the pressing portion 15*a* penetrates through the hole 16*a* of the ejector 16 and presses the lock pin 6. As the result, the lock pin 6 penetrates through the holes 7, 8 and 11 and is held at the predetermined connecting position in these holes, and the upper cover 2 and the lower cover 3 are connected together.

In this embodiment, approximately the same effect and the same benefit can be obtained as in the previous embodiment.

As described above, it is possible according to the buckle device of a seat belt unit of the present invention and the method for connecting the buckle cover in this buckle device, it is possible to assemble the lock pin or the release preventing member simply by moving the movable members of the seat belt unit. As the result, no special tool for assembling is required, and labor and time for assembling can be saved, and assembling procedure can be simplified to a great extent.

When the upper cover and the lower cover are connected together, the lock pin or the release preventing member in the connecting portion are positioned inside the buckle cover. Thus, these members are not seen from outside, and this gives good external appearance.

Further, the upper cover and the lower cover are mechanically and reliably connected together by the lock pin or the release preventing member, and this increases the reliability in the connecting force of the upper cover and the lower cover. Moreover, because the connecting portion is not seen from outside, mischievous disassembling of the buckle cover by outsiders can be perfectly prevented.

What we claim is:

1. A buckle device of a seat belt unit, comprising a buckle mechanism engaged with a tongue when the tongue is inserted into it as the seat belt is put on, a release member for releasing engagement of the tongue with the buckle mechanism, and a buckle cover formed by connecting an upper cover and a lower cover and for receiving at least a part of said buckle mechanism and said release member, whereby holes for connecting are formed on said upper cover and said lower cover, said upper cover and said lower cover are connected together by inserting a lock pin into these holes and by setting the covers at a predetermined connecting position, and said predetermined connecting position is set at such position that said lock pin can be set by a movable member of said seat belt unit.

2. A buckle device of a seat belt unit according to claim 1, wherein the movable member of said seat belt unit comprises said release member.

3. A buckle device of a seat belt unit according to claim 1, wherein the movable member of said seat belt unit comprises said tongue.

4. A buckle device of a seat belt unit according to claim 1, wherein an ejector is provided to push said tongue in a direction to disengage from said buckle mechanism when said tongue and said buckle mechanism are disengaged, and the movable member of said seat belt unit comprises said tongue and the ejector.

5. A buckle device of a seat belt unit, comprising a buckle mechanism engaged with a tongue when the tongue is inserted into it as the seat belt is put on, a release member for releasing engagement of the tongue with the buckle mechanism, and a buckle cover formed by connecting an upper cover and a lower cover and for receiving at least a part of said buckle mechanism and said release member, whereby an engaging portion is formed on each of said upper cover and said lower cover, disengagement of said upper cover from said lower cover is prevented because the engaging portions are engaged with each other against the disengaging direction of the upper and lower covers when said upper cover and said lower cover are connected together, a release checking groove is formed on at least one of these engaging portions, and disengagement of the engaging portion of said upper cover with the engaging portion of said lower cover is prevented by a release preventing member inserted into the release checking groove, further the engaging position of said release preventing member in the release checking groove is set at a position where said release preventing member can be inserted by a movable member of said seat belt unit.

6. A buckle device of a seat belt unit according to claim 2, wherein the movable member of said seat belt unit comprises said release member.

7. A buckle device of a seat belt unit according to claim 2, wherein the movable member of said seat belt unit comprises said tongue.

8. A buckle device of a seat belt unit according to claim 2, wherein an ejector is provided to push said tongue in a direction to disengage from said buckle mechanism when said tongue and said buckle mechanism are disengaged, and the movable member of said seat belt unit comprises said tongue and the ejector.

9. A method for connecting a buckle device in a seat belt unit, comprising a buckle mechanism engaged with a tongue when the tongue is inserted into it as the seat belt is put on, a release member for releasing engagement of the tongue with the buckle mechanism, and a buckle cover formed by connecting an upper cover and a lower cover and receiving at least a part of said buckle mechanism and said release member, whereby holes for connecting are formed in said upper and lower covers in an extended area of moving area of a movable member of said seat belt unit, a lock pin is temporarily fixed on moving area of the movable member of said seat belt unit in at least one of said upper cover and said lower cover or in the movable member of said seat belt unit, and said lock pin is inserted into said holes and is set at a predetermined connecting position by moving the movable member of the seat belt unit with said holes of said upper and lower covers kept in aligned state.

10. A method for connecting a buckle device of a seat belt unit according to claim 6, wherein the movable member of said seat belt unit is said release member, and by pushing said release member, said lock pin is inserted into said hole and is set at said predetermined connecting position or said release preventing member is inserted into said release checking groove.

11. A method for connecting a buckle device of a seat belt unit according to claim 6, wherein the movable member of said seat belt unit is said tongue, and by pushing said tongue into said buckle mechanism, said lock pin is inserted into said hole and is set to said predetermined connecting position or said release preventing member is inserted into said release checking groove.

12. A method for connecting a buckle device of a seat belt unit according to claim 6, wherein the movable member of said seat belt unit is said tongue and also is an ejector for pushing said tongue toward a direction to disengage from said buckle mechanism when said tongue is disengaged from said buckle mechanism, and by inserting said tongue into said buckle mechanism, said lock pin is inserted into said hole via said ejector and is set to said predetermined connecting position or said release preventing member is inserted into said release checking groove.

13. A method for connecting a buckle device in a seat belt unit, comprising a buckle mechanism engaged with a tongue when the tongue is inserted into it as the seat belt is put on, a release member for releasing engagement of the tongue with the buckle mechanism, and a buckle cover formed by connecting an upper cover and a lower cover and receiving at least a part of said buckle mechanism and said release member, whereby disengagement of said upper cover from said lower cover is prevented by engaging an engaging portion formed on each of said upper cover and said lower cover against disengaging direction of the upper and the lower covers when said upper cover and said lower cover are connected with each other, further a release checking groove is formed on an extended area of moving area of the movable member of said seat belt unit on one of these engaging portions, a release preventing member is temporarily fixed on moving area of the movable member of said seat belt unit on one of said upper cover or said lower cover or on the movable member of said seat belt unit, and disengagement of the engaging portion of said upper cover from the engaging portion of said lower cover is prevented by inserting said release preventing member into said release checking groove by moving the movable member of said seat belt unit.

14. A method for connecting a buckle device of a seat belt unit according to claim 7, wherein the movable member of said seat belt unit in said release member, and by pushing said release member, said lock pin is inserted into said hole and is set at said predetermined connecting position or said release preventing member is inserted into said release checking groove.

15. A method for connecting a buckle device of a seat belt unit according to claim 7, wherein the movable member of said seat belt unit is said tongue, and by pushing said tongue into said buckle mechanism, said lock pin is inserted into said hole and is set to said predetermined connecting position or said release preventing member is inserted into said release checking groove.

16. A method for connecting a buckle device of a seat belt unit according to claim 7, wherein the movable member of said seat belt unit is said tongue and also is an ejector for pushing said tongue toward a direction to disengage from said buckle mechanism when said tongue is disengaged from said buckle mechanism, and by inserting said tongue into said buckle mechanism, said lock pin is inserted into said hole via said ejector and is set to said predetermined connecting position or said release preventing member is inserted into said release checking groove.

* * * * *